US009347336B2

(12) United States Patent
Ito et al.

(10) Patent No.: US 9,347,336 B2
(45) Date of Patent: May 24, 2016

(54) STEAM VALVE APPARATUS

(71) Applicant: KABUSHIKI KAISHA TOSHIBA, Minato-ku (JP)

(72) Inventors: Daisuke Ito, Yokohama (JP); Tomoharu Tamaoki, Tokyo (JP); Osamu Shindo, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 181 days.

(21) Appl. No.: 14/260,654

(22) Filed: Apr. 24, 2014

(65) Prior Publication Data

US 2014/0319704 A1 Oct. 30, 2014

(30) Foreign Application Priority Data

Apr. 26, 2013 (JP) ..... 2013-094359

(51) Int. Cl.
*F01D 17/00* (2006.01)
*F01D 25/24* (2006.01)
*F01D 17/14* (2006.01)

(52) U.S. Cl.
CPC ..... *F01D 25/24* (2013.01); *F01D 17/00* (2013.01); *F01D 17/145* (2013.01)

(58) Field of Classification Search
CPC ..... F01D 17/00
USPC ..... 137/613, 614, 637.2
See application file for complete search history.

(56) References Cited

U.S. PATENT DOCUMENTS 8,042,570 B2 * 10/2011 Shindo ..... F01D 1/00 137/613
2009/0159141 A1 6/2009 Shindo

FOREIGN PATENT DOCUMENTS

| | | | |
|---|---|---|---|
| EP | 2 075 418 | A2 | 7/2009 |
| GB | 2 054 804 | A | 2/1981 |
| JP | 56-18167 | A | 2/1981 |
| JP | 57-152405 | U | 9/1982 |
| JP | 2009-156040 | | 7/2009 |

OTHER PUBLICATIONS

Extended European Search Report issued Sep. 9, 2014 in Patent Application No. 14166090.2.
Korean Office Action issued May 13, 2015 in Patent Application No. 10-2014-0047901 (with English Translation).

* cited by examiner

*Primary Examiner* — Robert A Hopkins
(74) *Attorney, Agent, or Firm* — Oblon, McClelland, Maier & Neustadt, L.L.P.

(57) ABSTRACT

According to one embodiment, there is provided a steam valve apparatus including a main throttle valve, a steam control valve arranged on a downstream side of the main throttle valve, and an intermediate flow-channel part which connects the main throttle valve and the steam control valve. The intermediate flow-channel part is a circular pipe flow channel forming a circular arcuate shape so as to change a flow of steam, which has flowed out of the main throttle valve, from a perpendicular direction into a direction of flowing out into the inlet part. An outlet part is open upward, and a valve rod penetrates a lower part of a casing downward.

4 Claims, 4 Drawing Sheets

STEAM VALVE APPARATUS

CROSS-REFERENCE TO RELATED APPLICATIONS

This application is based upon and claims the benefit of priority from prior Japanese Patent Applications No. 2013-094359, filed Apr. 26, 2013, the entire contents of which are incorporated herein by reference.

FIELD

Embodiments described herein relate generally to a steam valve apparatus having a main throttle valve and a steam control valve.

BACKGROUND

In typical conventional steam turbine plants, steam from a boiler is fed through a steam valve apparatus to a steam turbine. Steam after having performed mechanical work in the steam turbine is circulated to return to water by a steam condenser and is boosted and supplied again to a boiler by a feed water pump. The steam valve apparatus includes a main throttle valve and a steam control valve arranged on the downstream side of the former valve. The main throttle valve can instantly stop steam which flows into the steam turbine if an emergency occurs in the steam turbine, etc. The steam control valve controls the vapor flow rate of steam supplied to the steam turbine.

In several steam valve apparatuses, a main throttle valve and a steam control valve are integrated together to form a pair. For such integration, various combinations have been proposed. For example, in a known apparatus, a main throttle valve and a steam control valve are integrated through an intermediate flow-channel part, are each mounted longitudinally (vertical mount), and are configured to be driven by an oil cylinder provided in an upper side in a casing.

In a steam valve apparatus as described above in which a main throttle valve and a steam control valve are integrated through an elbow-shaped intermediate flow channel, centrifugal force acts to drive steam toward the outside of elbow-shaped curvature when steam coming out of the main throttle valve flows inside the intermediate flow channel.

The steam after passing the intermediate flow-channel part collides, as a jet stream additionally urged by centrifugal force and flow inertia, into inner walls of a valve cap and inner walls of a casing present in an extended direction of the curvature. Since the direction of the jet stream includes a lot of upward components (i.e., components in directions opposite to directions toward the side of a valve seat (outlet side)), the jet stream follows a flow route (trajectory) in which the flow direction is abruptly changed toward the valve seat (outlet side) of the steam control valve after the collision.

In such a structure in which a main throttle valve and a steam control valve are integrated through an elbow-shaped intermediate flow-channel part, a smooth flow of steam cannot be attained, and further, an energy loss caused when a steam flow which has passed an intermediate flow-channel part is jetted to collide becomes fatal so as to cause an energy loss of a steam valve apparatus.

Under the circumstances, it is desired to provide a steam valve apparatus capable of reducing the pressure loss at the time of opening a valve of the steam valve apparatus.

DETAILED DESCRIPTION

In general, according to one embodiment, there is provided a steam valve apparatus comprising a main throttle valve, a steam control valve arranged on a downstream side of the main throttle valve, and an intermediate flow-channel part which connects the main throttle valve and the steam control valve. The steam control valve includes: a casing which includes an inlet part connected to the intermediate flow-channel part, and an outlet part open in a perpendicular direction, and forms a flow channel between the inlet part and the outlet part, with a valve seat arranged in the flow channel; a valve body which is movable in up and down directions in the casing, and opens/closes the flow channel by separating/engaging from/with the valve seat; and a valve rod which is combined with the valve body, slides in up and down directions, penetrating a side opposite to the outlet part of the casing, and is moved to the side opposite to the outlet part at the time of opening the flow channel, the intermediate flow-channel part is a circular pipe flow channel forming a circular arcuate shape so as to change a flow of steam, which has flowed out of the main throttle valve, from a perpendicular direction into a direction of flowing out into the inlet part. The outlet part is open upward, and the valve rod penetrates a lower part of the casing downward.

Hereinafter, embodiments will be described with reference to the drawings. In the following description, components identical or similar to each other will be denoted with a common reference sign, and reiterative descriptions thereof will be omitted herefrom.

First Embodiment

Figure 1:
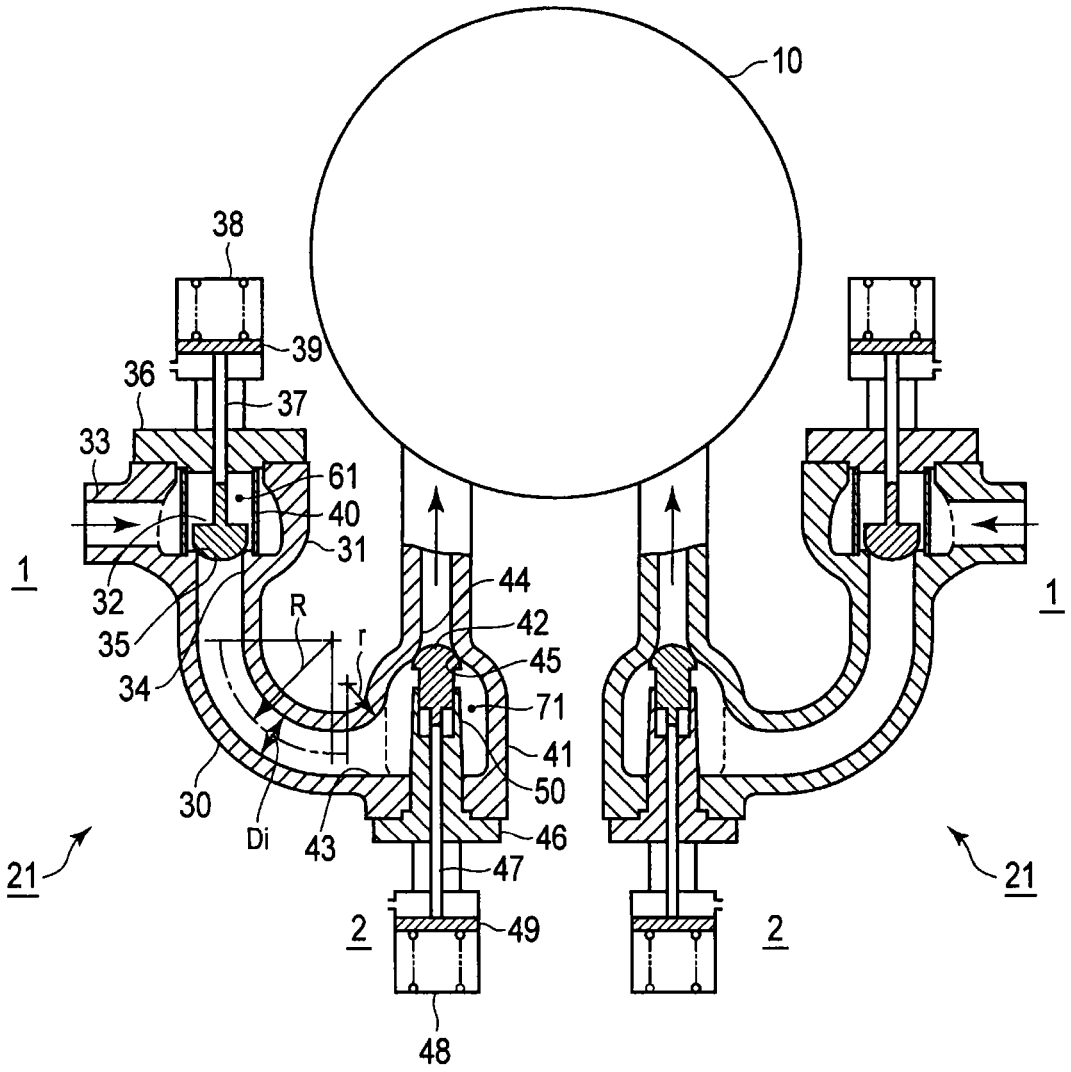
FIG. 1 is a longitudinal sectional view showing a configuration of a steam valve apparatus according to the first embodiment.
Figure 2:
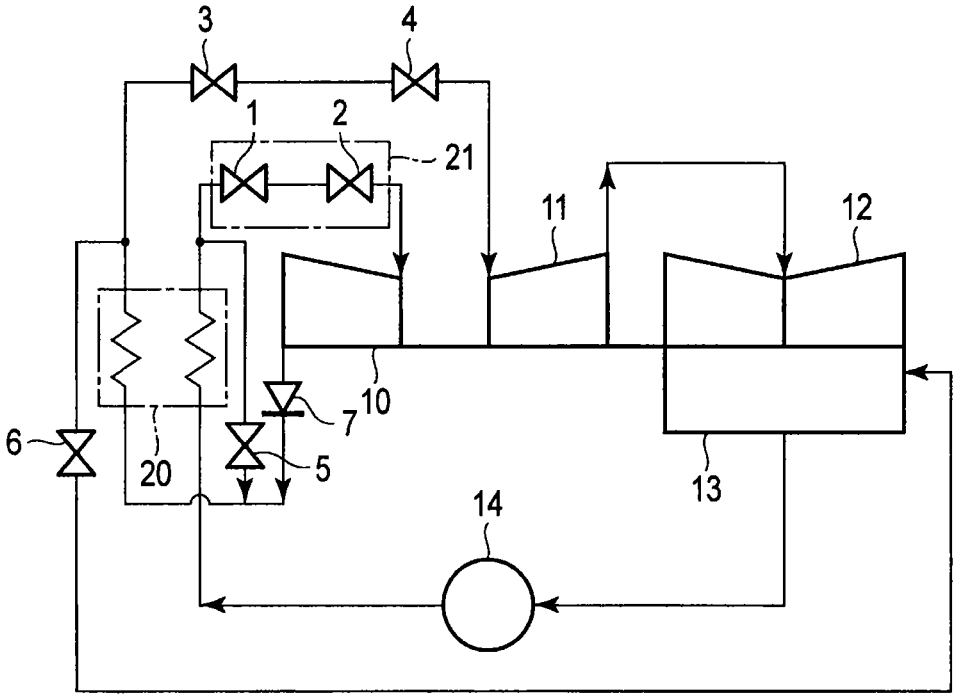
FIG. 2 is a system diagram showing a configuration of a steam turbine plant including the steam valve apparatus.

FIG. 1 is a longitudinal sectional view showing a configuration of a steam valve apparatus according to the first embodiment, and FIG. 2 is a system diagram showing a configuration of a steam turbine plant including a steam valve apparatus.

In FIG. 1, configurations in the left and right sides of the figure are the same as each other. Therefore, several reference signs denoted in the configuration of the left side are omitted from the configuration of the right side, for simplification. FIG. 2 is applicable also to a modification to the first embodiment and to the second embodiment which will be described later.

The steam valve apparatus of the present embodiment is applied, for example, to a steam turbine plant of low power output and is achieved in the form of a shell-mount-type structure in which the steam valve apparatus is directly attached to a chamber of a steam turbine. A part of the shell-mount-type steam valve apparatus is directly attached to, for example, a perpendicular lower or higher side of a high-pressure-steam turbine chamber.

As shown in FIG. 2, the steam turbine plant is configured such that steam from a boiler 20 is fed to a high-pressure-steam turbine chamber 10 after passing the steam valve apparatus 21. The steam valve apparatus 21 includes a main throttle valve 1 and a steam control valve 2 arranged on the downstream side of the former valve 1. Steam after having performed mechanical work in the high-pressure steam turbines 10 is then reheated by a reheater of the boiler 20 through a check valve 7, and is fed to a middle-pressure steam turbine 11 through an intercept valve 3 and thereafter to a low-pressure steam turbine 12 for further work. Steam which has come out of the low-pressure steam turbine 12 is returned to water by a steam condenser 13, then boosted by the feed water pump 14, and fed again to the boiler 20.

In the example of FIG. 2, there are provided a low-pressure-turbine bypass valve 6 connected to the upstream side of the reheater of the boiler 20 from the upstream side of the main throttle valve 1, and a high-pressure-turbine bypass valve 5 connected to the steam condenser 13 from the downstream side of the reheater, in order to improve operational efficiency of the plant. Irrespective of the operation of turbines, the boiler system can independently perform a circulating operation.

The steam valve apparatus 21 according to the present embodiment includes, as shown in FIG. 1, the main throttle valve 1 in the upstream side, the steam control valve 2 arranged in the downstream side, and an intermediate flow-channel part 30 which connects these valves. Both the main throttle valve 1 and the steam control valve 2 are of a longitudinal type (vertical mount). FIG. 1 shows a state where both the main throttle valve 1 and the steam control valve 2 are closed.

The main throttle valve 1 includes a first casing 31 which forms a first flow channel 61, and a first valve 32 which moves up and down within the first casing 31. In the first casing 31, a first inlet part 33 which is open in a horizontal direction and receives steam is formed, and a first outlet part 34 which is open in a perpendicular direction and discharges steam downward is formed. A first valve seat 35 which is convex in the middle is formed at the first outlet part 34, and is configured such that, when a first valve body 32 moves up or down, the first valve body 32 and the first seat 35 separate from or engage with each other, thereby opening or closing a first flow channel 61.

A first valve cap 36 which can be opened for maintenance is provided above the first casing 31. A first valve rod 37 is attached to the first valve body 32. The first valve rod 37 extends above the first valve body 32, penetrates a part of the first casing 31 corresponding to the valve cap 36 upward, and is connected to a first piston 39 in the first oil cylinder 38. Here, the first valve rod 37 is attached to the first valve 32 in a side opposite to the first outlet part 34, and is moved in a direction opposite to the first outlet part 34 when the first valve body 32 is released from the first valve seat 35 (i.e., when the first flow channel 61 is opened). A strainer 40 is provided inside the first casing 31 and outside the first valve 32.

The main throttle valve 2 includes a second casing 41 which forms a second flow channel 71, and a second valve 42 which moves up and down within the second casing 41. In the second casing 41, a second inlet part 43 which is open in a horizontal direction and receives steam is formed, and a second outlet part 44 which is open in a perpendicular direction and discharges steam upward is also formed. A second valve seat 45 which is convex in the middle is formed at the second outlet part 44, and is configured such that, when a second valve body 42 moves down or up, the second valve body 42 and the second seat 45 engage with or separate from each other, thereby closing or opening a second flow channel 71.

A second valve cap 46 which can be opened for maintenance is provided at a lower part of the second casing 41. The second flow channel 71 of the second casing 41 is formed to be surrounded by the inner wall of the second casing 41, the second valve seat 45, and the second valve cap 46.

The inner surface (end surface) of the second valve cap 46 in the second flow channel 71 continuously connects to a surface area of the inner surface of the intermediate flow-channel part 30, which curves in the outside, so as to allow steam from the intermediate flow-channel part 30 to smoothly flow into the flow channel 71.

Further, a surface area of the inner surface of the intermediate flow-channel part 30, which curves in the inside, and the inner surface of the casing 41 continuously connect to each other in the form of a circular arc having a radius of curvature r smaller than a center radius R of a circular arc of the intermediate flow-channel part 30, allowing smooth flow into the flow channel 71. The radius of curvature r may be increased to be substantially equal to the radius of curvature of a surface area of the inner surface of the intermediate flow-channel part 30, which curves in the inside.

The second valve cap 46 is configured to form a sleeve 50 extending toward the second valve seat 45 so as to protect the second valve 42 from steam flow, and to have steam, which flows in from the intermediate flow-channel part 30, pass between the inner surface of the second casing 41 and the outer surface of the sleeve 50, and flow out into the side of the second valve seat 45.

The second valve rod 47 is attached to the second valve body 42. The second valve rod 47 extends below the second valve body 42, penetrates a part of the second casing 41 corresponding to the valve cap 46 downward, and is connected to a second piston 49 in a second oil cylinder 48. Here, the second valve rod 47 is attached to the second valve 42 in a side opposite to the second outlet part 44, and is moved in a direction opposite to the second outlet part 44 when the second valve body 42 is released from the second valve seat 45 (i.e., when the second flow channel 71 is opened).

An unillustrated drain seat is provided below the second casing 41 and is configured to discharge drained steam which accumulates in the second casing 41 before startup of a steam turbine.

The intermediate flow-channel part 30 forms a circular arcuate elbow, which connects to the first outlet part 34 and the second inlet part 43 and has an arcuate angle (center angle of the circular arc) of 90 degrees. In order to avoid a phenomenon of fluid separation inside the intermediate flow-channel part (elbow) 30, a ratio (R/Di) between the center radius R of the circular arc of the intermediate flow-channel part 30 and an inner diameter Di of the intermediate flow-channel part 30 is desirably large. More desirably, the ratio (R/Di) is not smaller than 1, and much more desirably, the ratio is not smaller than 2. From a relationship of installation position relative to the chamber of the high-pressure steam turbine 10, FIG. 1 shows an example in which a short straight pipe directed horizontally is provided between the outlet of the intermediate flow-channel part 30 and the second inlet part 43. The ratio of the length of the straight pipe to the inside diameter Di of the intermediate flow-channel part 30 is so small that the length is too short to hydrodynamically rectify the flow, and is insufficient to increase the pressure loss caused by flow inside the piping. Therefore, a straight pipe having an appropriate length may be provided between the outlet of the intermediate flow-channel part 30 and the second inlet part 43.

The following is a method for achieving smoother streamlined flow of stream as a total smoother flow from the main throttle valve 1 through the intermediate flow-channel part 30 and through the steam control valve 2 to the high-pressure steam turbine 10, in comparison with FIG. 1. For example, a surface area of the inner surface of the intermediate flow-channel part 30, which curves in the inside, and the inner surface of the casing 41 are configured to continuously connect to each other in form of a circular arc having the radius of curvature r smaller than the center radius R of a circular arc of the intermediate flow-channel part 30. In addition, center points of these radii are positioned on one same line. As a result, the surface area of the inner surface of the intermediate flow-channel part 30, which curves in the inside, and the inner surface of the second casing 41 continuously and seamlessly connect to each other with a unique curvature of radius, and all flow channels are accordingly configured in one circular arc. Therefore, steam more smoothly flows into the flow channel 71.

Therefore, with the configuration as described above, smoother flow of steam can be obtained in comparison with the configuration of FIG. 1.

In the example of FIG. 1, the main throttle valve 1, the steam control valve 2 and the intermediate flow-channel part 30 are formed integrally by forging or casting. Though not shown in the figures, the main throttle valve 1, steam control valve 2, and intermediate flow-channel part 30 may be formed respectively as separate components by forging or casting. Thereafter, these components may be combined by structural welding into an integrated shape.

The steam valve apparatus 21 described above integrates the second outlet part 44 with the high-pressure steam turbine 10 by connecting the second outlet part 44 to a main steam pipe which projects to a perpendicular lower side of the chamber of the high pressure turbine 10. The same two valves (two apparatuses) are provided to be horizontally symmetrical to each other in relation to the high pressure steam turbine 10 as a center of symmetry. Depending on the capacity (output) of a steam turbine plant, only one valve (one apparatus) may be provided perpendicularly below the center of the chamber of the high pressure steam turbines 10.

In the steam valve apparatus 21 configured in this manner, main steam supplied from the boiler 20 (FIG. 4) flows into the first casing 31 of the main throttle valve 1 in a horizontal direction from the first inlet part 33, further flows into the strainer 40, passes between the first valve 32 and the first valve 35, and then passes the first outlet part 34 downward, thus passing the main throttle valve 1. The main steam which has passed the main throttle valve 1 passes the intermediate flow-channel part 30, thereby changing the flow direction from a downward direction to a horizontal direction, and flows into the second casing 41 of the steam control valve 2 in a horizontal direction from the second inlet part 43. The main steam which has flowed into the second casing 41 passes between the second valve 42 and the second valve seat 45, and passes the second outlet part 44 upward, thus passing the steam control valve 2

Since the second outlet 44 is connected to the perpendicular lower side of the high pressure steam turbine 10, main steam which has passed the steam control valve 2 flows upward into the chamber of the high pressure steam turbine.

In a general fluid flow inside the elbow forming the intermediate flow-channel part 30, centrifugal force acts on a fluid. The centrifugal force which acts on a part of the fluid in a center part where the flow speed is high is greater than the centrifugal force which acts on a part of the fluid in the vicinity of a wall surface where the flow speed is low. The fluid in the center part is therefore driven to the outside of the curve of the elbow, and the fluid near the pipe wall flows around to the inside of the curve of the elbow along the wall. Further, the pressure distribution on the wall surface is not uniform within cross sections of the elbow. The pressure is high on a wall part on the outside of the curve of the elbow while the pressure is low on a wall part on the inside thereof. Hence, secondary flow is known to occur inside the elbow.

In the first embodiment, the secondary flow flowing out of the intermediate flow-channel part 30 rectifies needless disturbance of steam inside the second flow channel 71 by branching into the left and the right from the center of the secondary flow (the center in axial directions) by the sleeve 50 of the second valve cap 46, thereby connecting to flow to the side of the second valve seat 45.

From the descriptions above, supposing that a section from the second inlet part 43 to the second outlet part 44 is a continuous pipe, the pipe can be considered as a 90-degree-curved pipe. Since the second outlet part 44 is directed upward, a continuous 180-degree-curved circular pipe channel (in the form of two 90-degree-curved elbows connected to each other) is formed when the intermediate flow-channel part 30 which is curved by 90 degrees and the 90-degree-curved pipe of the sector from the second inlet part 43 to the second outlet part 44 are combined together. A smooth flow can be attained from the throttle valve 1 through the intermediate flow-channel part 30 and through the steam control valve 2 to the high-pressure steam turbine 10.

That is, according to the prior art, an equivalent second output part is directed downward and a jet stream therefore collides into the inner wall of a valve cap of a steam control valve and the inner wall of a casing, thereby causing an energy loss (i.e., pressure loss). However, according to the present embodiment, the energy loss (i.e., pressure loss) can be reduced by directing the second outlet part 44 upward, and the pressure loss of the whole steam valve apparatus 21 can be reduced accordingly.

Modification to First Embodiment

Figure 3:
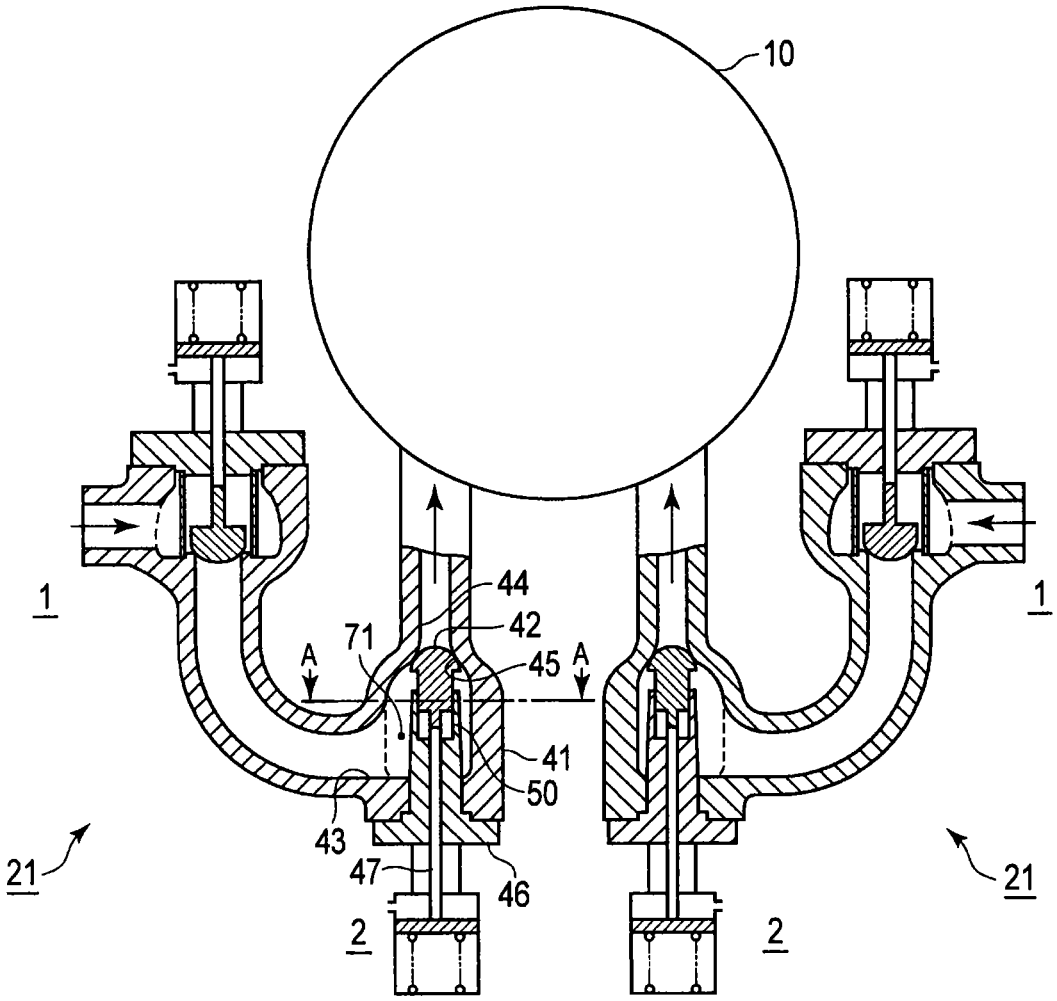
FIG. 3 is a longitudinal sectional view showing a configuration of a modification to the steam valve apparatus according to the first embodiment.
Figure 4:
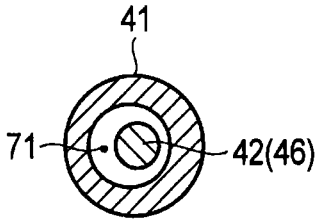
FIG. 4 is a cross-sectional view showing a shape of a cross section of a portion indicated by arrows A-A in FIG. 3.

FIG. 3 shows a configuration of a modification to the steam valve apparatus according to the first embodiment, and FIG. 4 is a cross-sectional view showing the shape of a cross section a portion indicated by arrows A-A shown in FIG. 3.

In the first embodiment described above (FIG. 1), the inner surface (end surface) part of the second valve cap 46 in the side opposite to the second inlet part 43 forms a stagnation point where steam flowing into the second flow channel 71 does not flow around but remains, and therefore is a factor which increases the pressure loss. The modification to the first embodiment solves such a problem.

In the modification to the first embodiment shown in FIG. 3, even when steam which has passed the intermediate flow-channel part 30 flows into the second casing 41 in the first embodiment (FIG. 1), the inner diameter of the second casing 41 is reduced, thereby reducing the space opposite to the side of the second inlet part 43 to the extent that the flow speed of the steam does not drop, i.e., the cross-sectional area of the second flow channel 71 in the steam flow direction does not become a factor which causes an abrupt increase.

This can be achieved by thickening, for example, the inner wall of the second casing 41 in the side opposite to the second inlet part 43. In this manner, as shown in FIGS. 3 and 4, the space around the second valve 42, second valve rod 47, and second valve cap 46 in the second casing 41 is smaller in the side opposite to the second inlet port 43 than in the side of the second inlet part 43.

Structurally, the position of the inner wall of the second inlet part 43 of the second casing 41 is left unchanged while inner dimensions of the second casing 41 are reduced. Consequently, the center position of the inner wall is shifted and deviated to the side of the second inlet part 43 in relation to the center of the outer surface (exterior surface) of the second casing 41.

As a result, a main flow channel is securely maintained in the side of the second inlet part 43, and steam can be made to flow uniformly from around the second valve body 42 to the side of the second valve seat 45, together with an optimal quantity of steam which flows around to the side opposite to the second inlet part 43. A smooth steam flow without disturbance is obtained in the second flow channel 71. Therefore, an increase in pressure loss can be suppressed.

Second Embodiment

Figure 5:
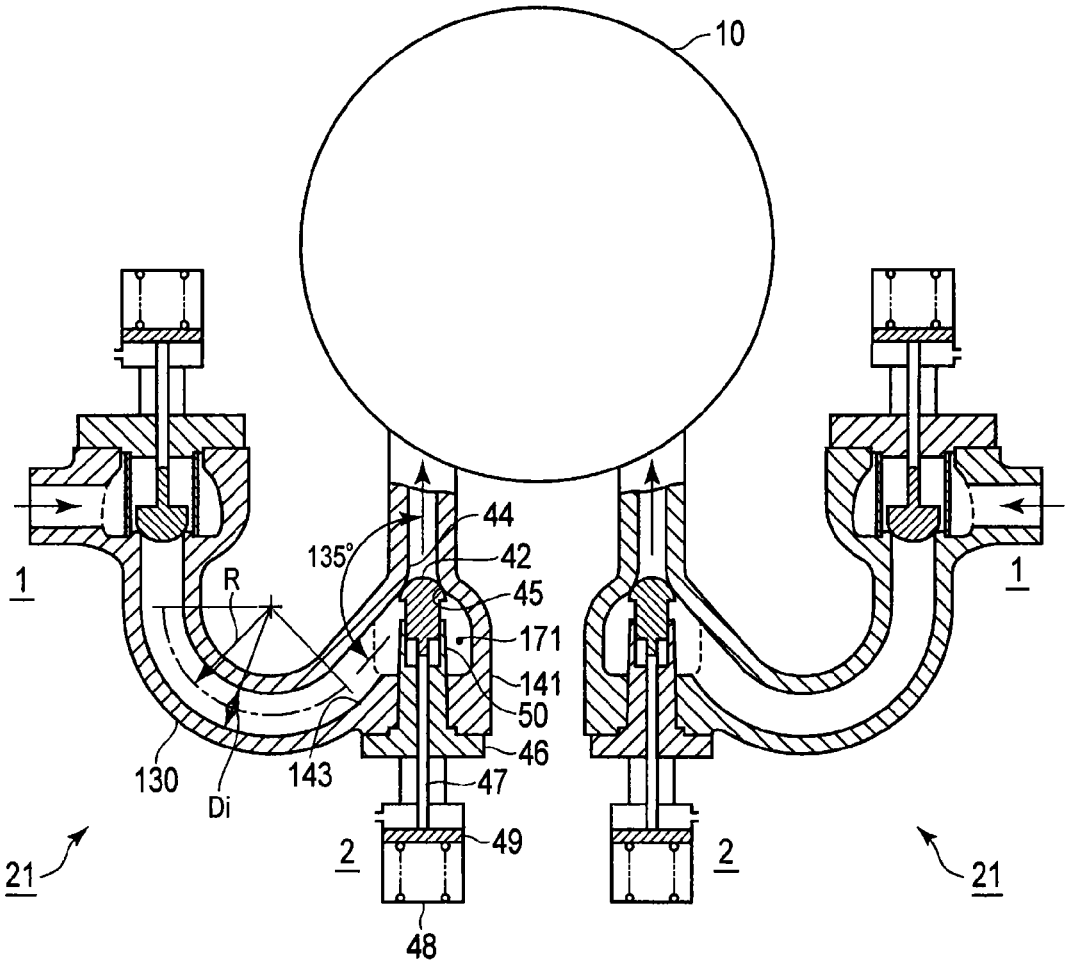
FIG. 5 is a longitudinal sectional view showing a configuration of a steam valve apparatus according to the second embodiment.

FIG. 5 is a longitudinal sectional view showing a configuration of a steam valve apparatus according to the second embodiment. A steam valve apparatus according to the second embodiment has substantially the same structure as the steam valve apparatus according to the first embodiment. Therefore, descriptions will be made below focusing on different parts therebetween.

A main throttle valve 1 is configured with the same structure as in the first embodiment, and descriptions thereof will therefore be omitted.

The configuration of a steam control valve 2 is also the same as in the first embodiment except that a second casing 141 forming a second flow channel 171 and a second inlet part 143 have different shapes from those in the first embodiment.

The configuration of an intermediate flow-channel part 130 differs in its structure from the first embodiment.

A steam valve apparatus 21 according to the second embodiment includes, as shown in FIG. 5, a main throttle valve 1 on the upstream side, a steam control valve 2 provided on the downstream side of the former valve, and an intermediate flow-channel part 130 which connects these valves. Both the main throttle valve 1 and the steam control valve 2 are of a longitudinal type (vertical mount). FIG. 5 shows a state where both the main throttle valve 1 and the steam control valve 2 are closed.

The main throttle valve 2 includes a second casing 141 which forms a second flow channel 171, and a second valve body 42 which moves up and down within the second casing 141. Formed in the second casing 141 are a second inlet part 143 which is open at an inclination in a direction of 135 degrees to the center line of the second casing 141 and receives steam, and a second outlet part 44 which is open in a perpendicular direction and discharges steam upward. A second valve seat 45 which protrudes inward is formed at the second outlet part 44, and is configured such that, when a second valve body 42 moves down or up, the second valve body 42 and the second valve seat 45 separate from or engage with each other, thereby opening or closing a second flow channel 171.

A second valve cap 46 which can be opened for maintenance is provided at a lower part of the second casing 141. The second flow channel 171 of the second casing 141 is formed to be surrounded by the inner wall of the second casing 141, the second valve seat 45, and a second valve cap 46.

The intermediate flow-channel part 130 is connected to the second inlet part 143, in the form of a circular arc having a center radius R, and forms gentle flow which matches a slope of the second valve seat 45 forming part of the second flow channel 171. A sleeve 50 extending toward the side of the second valve seat 45 to protect the second valve body 42 from steam flow is formed on the valve cap 46, and is configured to make steam, which has flowed in from the intermediate flow-channel part 130, flow between the inner surface of the second casing 141 and the outer surface of the sleeve 50 out to the side of the second valve seat 45. A second valve rod 47 is attached to the second valve body 42. The second valve rod 47 extends below the second valve body 42, penetrates the part of the valve cap 46 of the second casing 141 downward, and is connected to a second piston 49 in a second oil cylinder 48. Here, the second valve rod 47 is attached to the second valve body 42 in the side opposite to the second outlet part 44, and is moved in a direction opposite to the second outlet part 44 when the second valve body 42 is released from the second seat 45 (i.e., when the second flow channel 171 is opened).

An unillustrated drain seat is provided at a bottom part of the intermediate flow-channel part 130 which has the lowest level, and is configured to discharge drained steam which accumulates in the second casing 141 before startup of the steam turbine.

The intermediate flow-channel part 130 forms a flow channel which connects a first outlet part 34 and the second inlet part 143 to each other, and has an arcuate angle (i.e., the center angle of a circular arc) of 135 degrees. The inner surface of the intermediate flow-channel part 130 and the inner surface of the second inlet part 143 are configured to continuously connect to each other at this time. As a result, the intermediate flow-channel part 130 and the inlet part 143 continuously and seamlessly connect to each other. Therefore, steam more smoothly flows into the flow channel 171.

The ratio (R/Di) between the center radius R of the circular arc of the intermediate flow-channel part 130 and the inside diameter Di of the intermediate flow-channel part 130 is desirably large. The ratio (R/Di) is more desirably not smaller than 1 or much more desirably not smaller than 2.

From a relationship of installation position relative to a chamber of a high-pressure steam turbine 10, a much greater center radius R of the circular arc of the intermediate flow-channel part 130 may be set, and a short straight pipe may be provided between the outlet of the intermediate flow-channel part 130 and the second inlet part 143 as in the first embodiment (FIG. 1). Further, as in the modification to the first embodiment (FIGS. 3 and 4), the position of the inner wall of the second inlet part 143 of the second casing 141 may be left unchanged while inner dimensions of the second casing 141 may be reduced. The center position of the inner wall may be shifted and deviated to the side of the second inlet part 143 in relation to the center of the outer surface (the surface of exterior shape) of the second casing 141.

Although the inclination angle at which the intermediate flow-channel part 130 and the second inlet part 143 connect to each other is desirably 135 degrees, the inclination angle is not limited to this angle insofar as the angle is structurally acceptable.

In the steam valve apparatus 21 configured as described above, main steam which has passed the main throttle valve 1 passes the intermediate flow-channel part 130, thereby changing the flow direction from a downward direction to an upward direction, and flows into the second casing 141 of the control valve 2 from the inclined second inlet part 143. The steam which has flowed into the second casing 141 passes between the second valve body 42 and the second valve seat 45, and passes the second outlet part 44 upward, thus passing the steam control valve 2.

Since the second outlet part 44 is connected to a perpendicular lower side of the high-pressure steam turbine 10, the main steam which has passed the steam control valve 2 flows upward into the chamber of the high-pressure steam turbine.

In the first embodiment described above (FIG. 1), a section from a second inlet part 43 to a second outlet part 44 is supposed to be a 90-degree curved pipe, the shape of which is rather a right-angled pipe (an unrounded pipe) than a curved pipe. Therefore, the section from the first outlet part 34 to the second outlet part 44 through an intermediate flow-channel part 130 is far from a flow channel of an ideal continuous 180-degree-curved circular pipe (i.e., a flow channel formed of two 90-degree elbows connected to each other). Therefore, the first embodiment described above has the potential to cause needless pressure loss when steam passes from the second inlet part 43 to the second outlet part 44.

On the other hand, according to the present second embodiment, the second inlet part 43 is inclined at 135 degrees, and the right-angled pipe is therefore removed.

By thus arranging the configuration, a smoother flow of steam can be achieved in comparison with the first embodiment described above (FIG. 1), and an increase in pressure loss can be suppressed.

As specifically described above, according to each of the embodiments, a pressure loss at the time of opening valves in a steam valve apparatus can be reduced.

According to the steam valve apparatus in each of the embodiments, the second outlet part 44 of the second casing 41 (or 141) is directed upward. Therefore, a steam valve apparatus of a shell, mount type can be obtained in which a second outlet part 44 of a second casing 41 (or 141) is located perpendicularly below a turbine chamber. In this respect, in the prior art, a long pipe directed upward needs to be additionally connected since the second outlet part of the second casing is directed downward. In contrast, according to the steam valve apparatus of each of the embodiments, no additional pipe needs to be connected, making direct assembly possible, which facilities a more compact configuration.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

The invention claimed is:

1. A steam valve apparatus comprising a main throttle valve, a steam control valve arranged on a downstream side of the main throttle valve, and an intermediate flow-channel part which connects the main throttle valve and the steam control valve, wherein the steam control valve includes:

a casing which includes an inlet part connected to the intermediate flow-channel part, and an outlet part open in a perpendicular direction, and forms a flow channel between the inlet part and the outlet part, with a valve seat arranged in the flow channel;

a valve body which is movable in up and down directions in the casing, and opens/closes the flow channel by separating/engaging from/with the valve seat; and a valve rod which is combined with the valve body, slides in up and down directions, penetrating a side opposite to the outlet part of the casing, and is moved to the side opposite to the outlet part at the time of opening the flow channel, the intermediate flow-channel part is a circular pipe flow channel forming a circular arcuate shape so as to change a flow of steam, which has flowed out of the main throttle valve, from a perpendicular direction into a direction of flowing out into the inlet part, and the outlet part is open upward, and the valve rod penetrates a lower part of the casing downward.

2. A steam valve apparatus comprising a main throttle valve, a steam control valve arranged on a downstream side of the main throttle valve, and an intermediate flow-channel part which connects the main throttle valve and the steam control valve, wherein the main throttle valve includes:

a first casing which includes a first inlet part open in a horizontal direction, and a first outlet part open in a perpendicular direction and connected to the intermediate flow-channel part, and forms a first flow channel between the first inlet part and the first outlet part, with a first valve seat arranged in the first flow channel;

a first valve body which is movable in up and down directions in the casing, and opens/closes the first flow channel by separating/engaging from/with the first valve seat; and a first valve rod which is combined with the first valve body, slides in up and down directions, penetrating a side opposite to the first outlet part of the first casing, and is moved to a side opposite to the first outlet part at a time of opening the first flow channel, the steam control valve includes:

a second casing which includes a second inlet part open in a horizontal direction and connected to the intermediate flow-channel part, and a second outlet part open in a perpendicular direction, and forms a second flow channel between the second inlet part and the second outlet part, with a second valve seat arranged in the second flow channel;

a second valve body which is movable in up and down directions in the casing, and opens/closes the first flow channel by separating/engaging from/with the second valve seat; and a second valve rod which is combined with the second valve body, slides in up and down directions, penetrating a side opposite to the second outlet part of the second casing, and is moved to a side opposite to the second outlet part at the time of opening the second flow channel, the intermediate flow-channel part is a circular pipe flow channel forming a circular arcuate shape having a center angle of 90 degrees so as to change a flow of steam, which has flowed out of the first outlet part, from a perpendicular into a horizontal direction of flowing out into the second inlet part, the first outlet part is open downward, the first valve rod penetrates an upper part of the first casing upward, the second outlet part is open upward, and the second valve rod penetrates a lower part of the second casing downward.

3. The steam valve apparatus according to claim 2, wherein space around the second valve body and the second valve rod in the second casing is smaller in a side opposite to the second inlet part than in a side of the second inlet part.

4. A steam valve apparatus comprising a main throttle valve, a steam control valve arranged on a downstream side of the main throttle valve, and an intermediate flow-channel part which connects the main throttle valve and the steam control valve, wherein the main throttle valve includes:

a first casing which includes a first inlet part open in a horizontal direction, and a first outlet part open in a perpendicular direction and connected to the intermediate flow-channel part, and forms a first flow channel between the first inlet part and the first outlet part, with a first valve seat arranged in the first flow channel;

a first valve body which is movable in up and down directions in the casing, and opens/closes the first flow channel by separating/engaging from/with the first valve seat; and a first valve rod which is combined with the first valve body, slides in up and down directions, penetrating a side opposite to the first outlet part of the first casing, and is moved to a side opposite to the first outlet part at a time of opening the first flow channel, the steam control valve includes:

a second casing which includes a second inlet part open at an inclination of 135 degrees in relation to a center line of the second casing and connected to the intermediate flow-channel part, and a second outlet part open in a perpendicular direction, and forms a second flow channel between the second inlet part and the second outlet part, with a second valve seat arranged in the second flow channel;

a second valve body which is movable in up and down directions in the casing, and opens/closes the first flow channel by separating/engaging from/with the second valve seat; and a second valve rod which is combined with the second valve body, slides in up and down directions, penetrating a side opposite to the second outlet part of the second casing, and is moved to the side opposite to the second outlet part at the time of opening the second flow channel, the intermediate flow-channel part is a circular pipe flow channel forming a circular arcuate shape having a center angle of 135 degrees so as to change a flow of steam, which has flowed out of the first outlet part, from a perpendicular direction into a 45-degree upward direction of flowing out into the second inlet part, the first outlet part is open downward, the first valve rod penetrates an upper part of the first casing upward, the second outlet part is open upward, and the second valve rod penetrates a lower part of the second casing downward.

* * * * *